United States Patent [19]

Adams, Jr. et al.

[11] 4,306,628

[45] Dec. 22, 1981

[54] SAFETY SWITCH FOR WELL TOOLS

[75] Inventors: James B. Adams, Jr., Lewisville; Thomas M. Deaton, Dallas, both of Tex.

[73] Assignee: Otis Engineering Corporation, Dallas, Tex.

[21] Appl. No.: 122,759

[22] Filed: Feb. 19, 1980

[51] Int. Cl.[3] ..... E21B 43/11

[52] U.S. Cl. ..... 175/4.56; 175/4.52; 102/301; 200/82 R

[58] Field of Search ..... 175/4.51–4.54, 175/4.56; 102/20; 200/82 R

[56] References Cited

U.S. PATENT DOCUMENTS 3,447,604 6/1969 Kinley et al. ..... 175/4.56

3,546,478 12/1970 Lindsey ..... 307/116

3,800,705 4/1974 Tamplen ..... 175/4.54

*Primary Examiner*—William F. Pate, III

*Attorney, Agent, or Firm*—Thomas R. Felger

[57] ABSTRACT

A mechanical safety switch for closing electrical contacts in a well tool. The mechanical switch has several safety requirements which must be satisfied before the electrical contacts will close including upward pull on a wireline and a preselected value of fluid pressure exterior to the switch. The safety switch can be incorporated into a well perforating gun to provide safe, reliable operation of an electrically powered perforating gun by a conventional wireline. Preferably, the electrical circuits of the well perforating gun should include a motion sensor and a timer for increased safety.

26 Claims, 11 Drawing Figures

SAFETY SWITCH FOR WELL TOOLS

BACKGROUND OF THE INVENTION

1. Field of the Invention

This invention is related to a switch for closing electrical contacts in a well tool such as an oil well perforating gun.

2. Description of the Prior Art

Various safety devices or safety switches have been developed to allow for controlled detonation of explosive charges downhole in a well bore. Frequently, the explosive charge is designed to penetrate a well flow conductor, such as tubing and/or casing, disposed within the well bore to allow fluids surrounding the well bore to communicate with the interior of the well flow conductor. Tools which perform this function are frequently referred to as well perforating guns. The controlled detonation of explosive charges downhole may also be used for other purposes such as anchoring well tools within a well flow conductor or jarring loose well tools that are stuck within the well bore.

U.S. Pat. No. 3,183,972 to John V. Fredd discloses a perforator hanger for anchoring a well perforating gun at a desired location within a well flow conductor. The perforating gun is electrically detonated after a conventional, non-conductive wireline has anchored the perforating gun within the well flow conductor and completed the electrical circuits within the perforating gun.

U.S. Pat. No. 3,199,287 to John C. Kinley; U.S. Pat. No. 3,366,179 to John C. Kinley, Myron M. Kinley, and Clifford E. Anderson; and U.S. Pat. No. 3,411,597 to Myron M. Kinley and Clifford E. Anderson disclose mechanical safety devices and mechanical detonators for controlling the detonation of explosive charges downhole in a well flow conductor.

U.S. Pat. No. 4,172,421 to John A. Regalbuto discloses a well perforating gun which is mechanically armed at the well surface and detonated downhole by an electrically conductive wireline. U.S. Pat. Nos. 3,183,972 and 4,172,421 are adopted by reference for all purposes within the application.

SUMMARY OF THE INVENTION

The present invention discloses a switch for activating electrical circuits in a well tool comprising a housing, means for attaching one end of the housing to a wireline, a piston slidably disposed within the housing, a first electrical contact comprising a pin projecting from one end of the piston, the piston having a first position in which it is held from sliding relative to the housing with the pin spaced longitudinally from a second electrical contact in the switch and a second position in which the pin can engage the second electrical contact, means for holding the piston in its first position, and means for releasing the piston from the holding means.

One object of the present invention is to provide a mechanical switch which can close electrical contacts in a well tool, suspended downhole from a conventional wireline.

Another object of the present invention is to provide a mechanical switch which will close electrical contacts in a well tool, suspended downhole from a conventional wireline, when the pressure of fluid surrounding the well tool exceeds a predetermined value.

Still another object of the present invention is to provide a well perforating gun having multiple safety devices which must be activated before explosive charges carried by the well perforating gun are detonated. The safety features are upward pull on the wireline while the perforating gun is disposed within a flow conductor, a predetermined amount of fluid pressure exterior to the perforating gun, and no movement of the perforating gun for a preselected time interval.

The object of an alternative embodiment of the present invention is to provide a mechanical switch which can close two electrical contacts without regard to the fluid pressure exterior to the mechanical switch.

A further object of the present invention is to provide a mechanical switch which can be used to close electrical contacts in a well perforating gun, suspended within a well flow conductor from a conventional wireline.

Additional objects and advantages of the present invention will be readily apparent to those skilled in the art after reading the written description and claims in conjunction with the accompanying drawings.

DESCRIPTION OF THE PREFERRED EMBODIMENTS

Figure 1A:
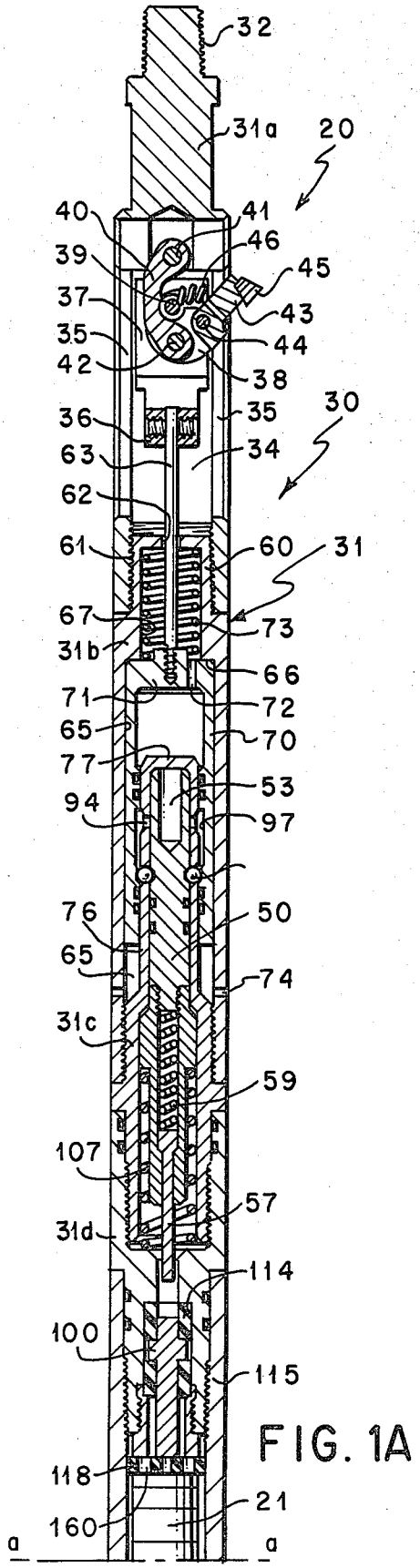
FIGS. 1A, 1B, and 1C are drawings, partially in section and partially in elevation, showing a well perforating gun and a safety switch incorporating the present invention.
Figure 1B:
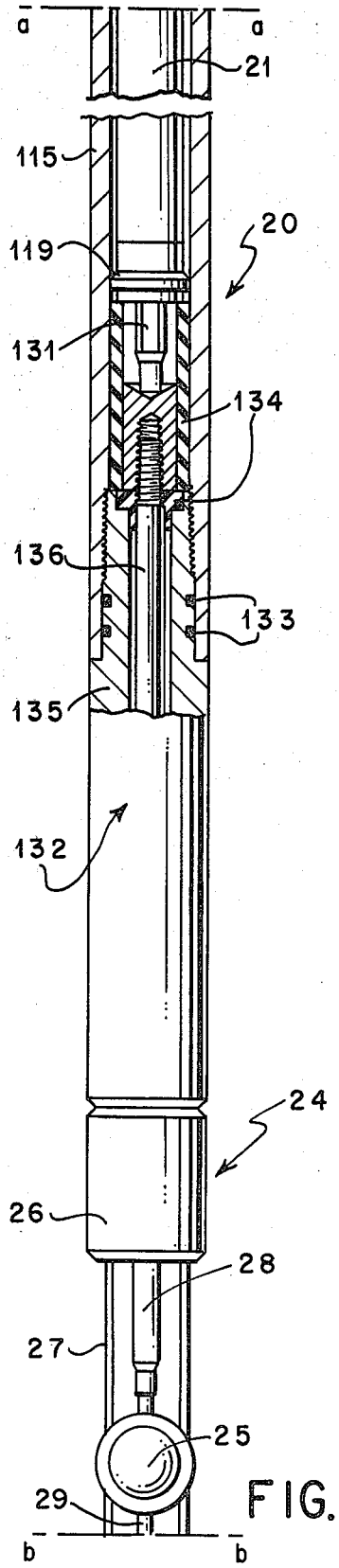
Figure 1C:
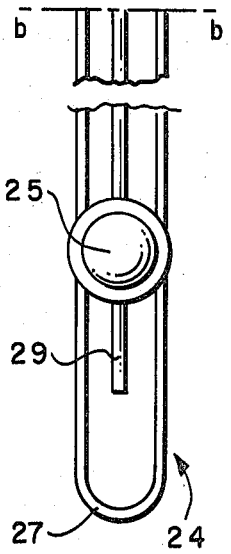

Referring to the drawings and specifically FIGS. 1A, 1B, and 1C, safety switch 30 is shown as part of well perforating gun 20. The present invention can be readily adapted for use in other downhole well tools in addition to perforating gun 20. One example of such other downhole well tools would be to use safety switch 30 to detonate the explosive charge used to set the packer in U.S. Pat. No. 2,640,547 to R. C. Baker et al. U.S. Pat. No. 2,640,547 is incorporated by reference for all purposes.

Perforating gun 20 has three major subassemblies which are safety switch 30, power supply 21 including timer 22 and motion sensor 23, and explosive charge carrier 24. The major function of safety switch 30, later described in detail, is to close electrical contacts 57 and 100 when safety switch 30 and the well tool attached thereto are at a desired location within a well flow conductor.

Figure 6:
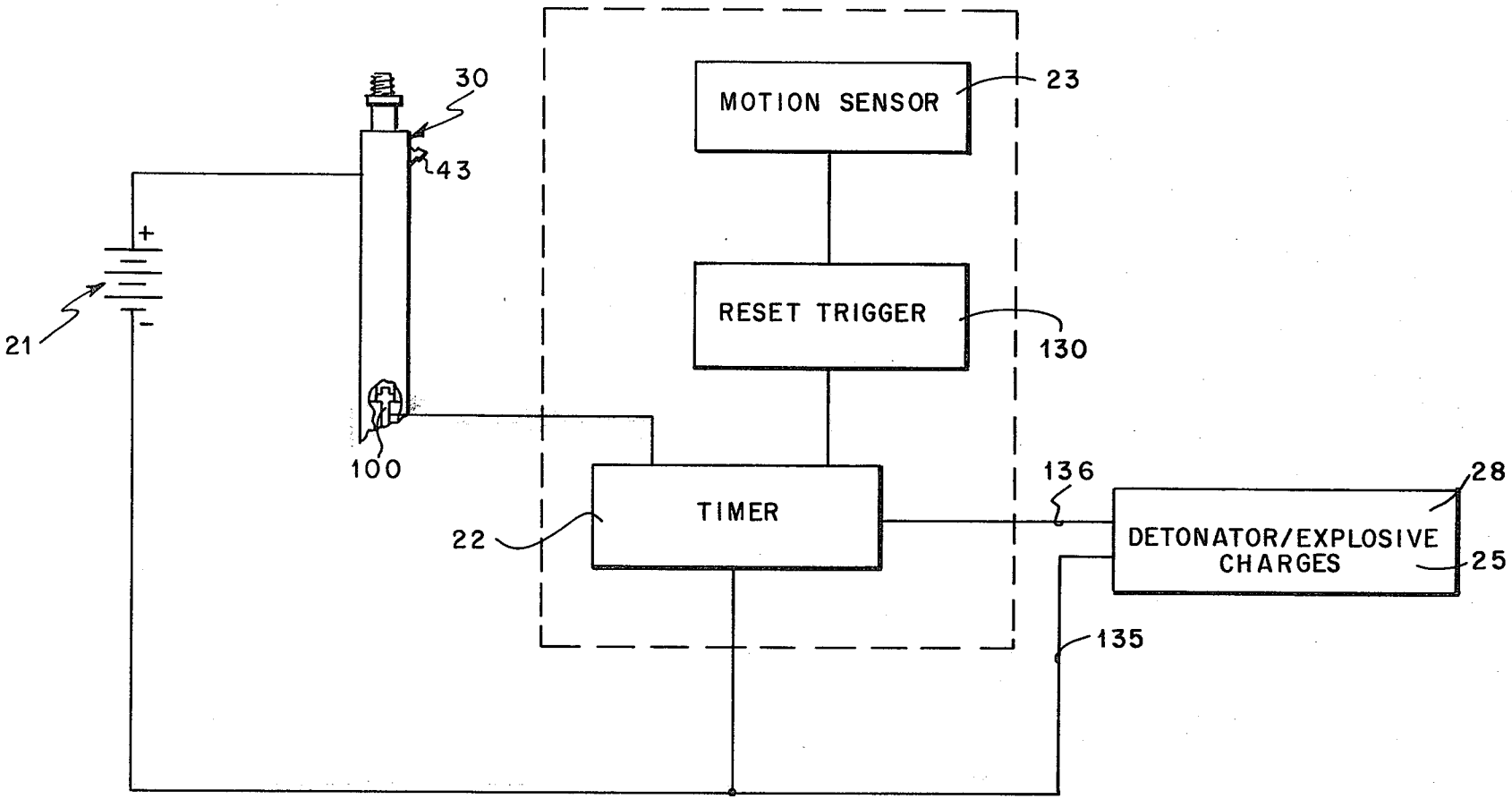
FIG. 6 is a one line, electrical schematic drawing for the well perforating gun shown in FIGS. 1A, 1B, and 1C.

Various power supplies are commercially available which could be used to detonate explosive charges 25 carried by perforating gun 20. Preferably, for enhanced safety and controlled detonation of explosive charges 25, power supply 21 should include timer 22 and motion sensor 23 as shown in FIG. 6. U.S. Pat. No. 3,546,478 to James M. Lindsey discloses a power supply, timer, and motion sensor satisfactory for use with the present invention. U.S. Pat. No. 3,546,478 is adopted by reference for all purposes.

Carrier 24 includes an adapter sub 26 which secures carrier 24 to the other subassemblies of perforating gun 30. Supporting member 27 extends longitudinally from adapter sub 26 in the shape of an extended U. The spacing between the two legs of member 27 is sized to be compatible with the outside diameter of perforating gun 20. Preferably, the outside diameter of adapter sub 26 is the largest outside diameter of any subassembly of perforating gun 20. Detonator 28 extends longitudinally from the center of adapter sub 26 between the two legs of supporting wire 27. Explosive charges 25 are attached to the two legs of supporting member 27 as desired. The length of supporting member 27 and the number of charges 25 can be varied as required for each well. A fast burning fuse 29 such as Primacord connects each explosive charge to detonator 28. Various carriers 24 and explosive charges 25 are commercially available for use with perforating gun 20. Examples of these carriers and explosive charges are shown in the Composite Catalog of Oil Field Equipment & Services 1978-79, Volume 2, pages 2856 and 2857.

Figure 5A:
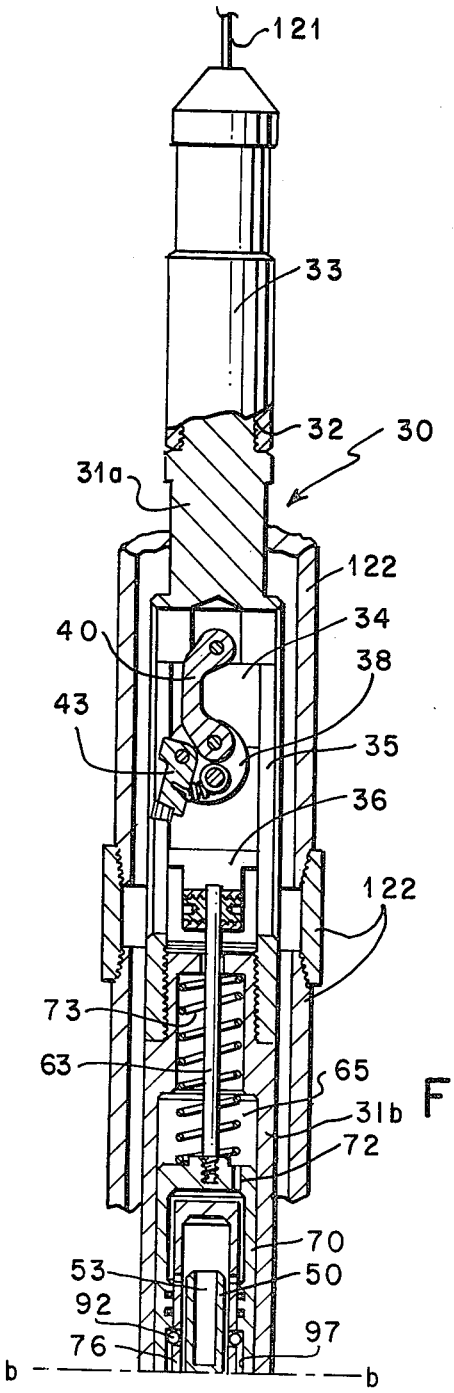
FIGS. 5A and 5B are drawings, partially in section and partially in elevation, showing a well tool, having the safety switch of the present invention, suspended from a conventional wireline within a well flow conductor. The piston is in its second position with the electrical contacts engaged.
Figure 5B:
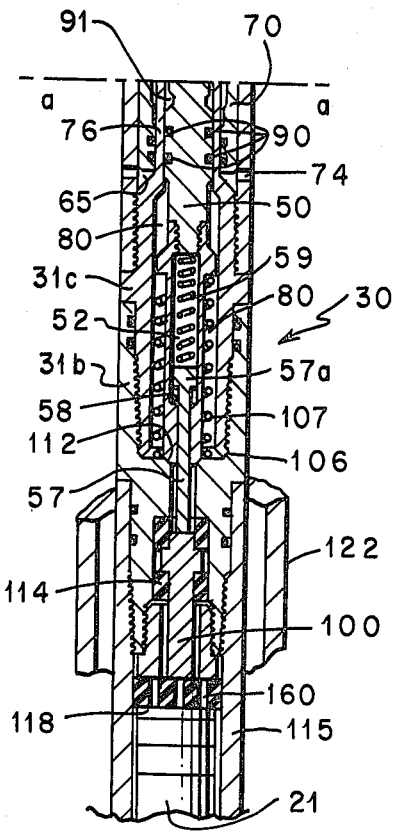

Safety switch 30 comprises a housing 32 formed by a plurality of generally cylindrical subassemblies each having a longitudinal bore and threaded for interconnection to the adjacent subassembly. First housing subassembly 31*a* has threads 32 formed on one end for attaching housing 31 to wireline running tool 33 as shown in FIG. 5A. Longitudinal bore 34 extends partially through housing subassembly 31*a* from the other end thereof. Two opposed, longitudinal slots 35 are machined through the exterior of subassembly 31*a* intermediate the ends thereof. Slots 35 allow unrestricted communication of fluids between bore 34 and the exterior of housing 31.

As will be later described in detail, piston 50 is releasably disposed within housing 31. A portion of the means for releasing piston 50, so that piston 50 can slide longitudinally within housing 31, is carried within bore 34. Release plunger or yoke 36 is slidably disposed within bore 34. Plunger 36 has two opposed release plates 37, one of which is shown in FIG. 1A. Release plates 37 are preferably segments of a cylinder having a radius compatible with the inside diameter of bore 34. Release disc 38 is rotatably secure between release plates 37 by fastener 39. Fastener 39 is offset from the center of disc 38. Release link 40 has one end attached directly to housing subassembly 31*a* within the one end of bore 34 by dowel pin 41. The other end of release link 40 is attached to disc 38 by pivot pin 42. Pivot pin 42 is offset from the center of disc 38 and from fastener 39. Release dog or trigger 43 is attached to disc 38 by pin 44. Pin 44 is offset from the center of disc 38, fastener 39, and pivot pin 42. Release spring 46 is attached to trigger 43 and pivot pin 42 to allow limited relative movement of trigger 43 with respect to disc 38. Spring 46 tends to return trigger 43 to its initial position with respect to disc 38. For this written description, disc 38 has been referred to in the singular. In actual practice, it has been found more reliable to sandwich trigger 43 and spring 46 between a pair of discs 38.

Figure 2A:
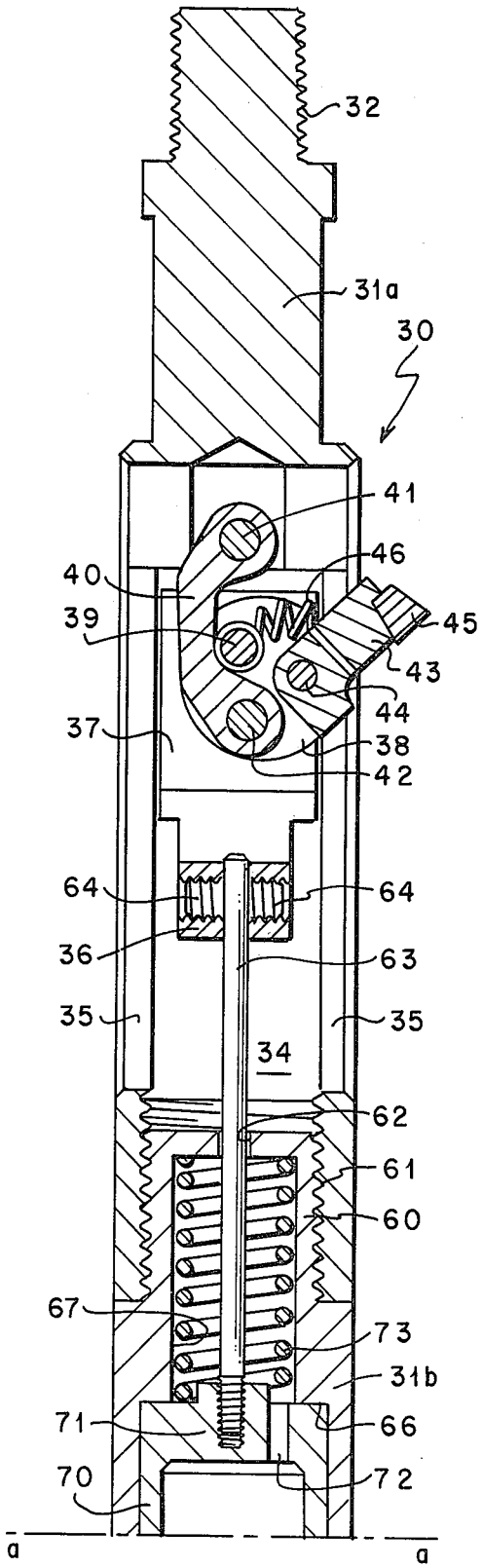
FIGS. 2A and 2B are enlarged drawings, partially in section and partially in elevation, showing the safety switch in its alternative configuration for closing the electrical contacts without regard to the fluid pressure exterior to the safety switch. The piston is shown in its first position.
Figure 3A:
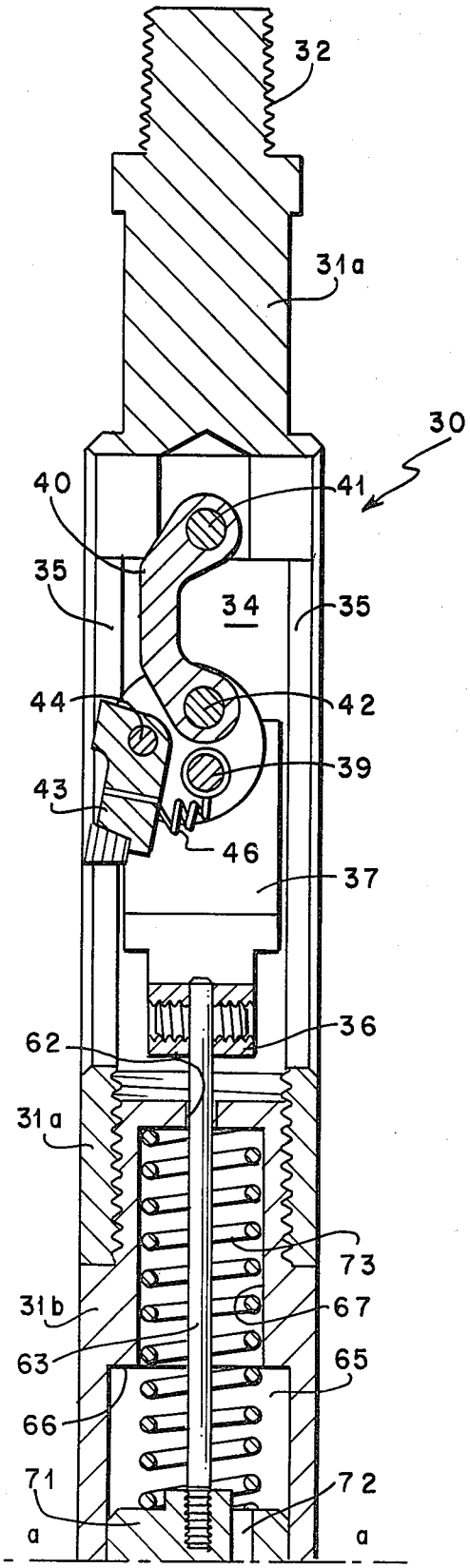
FIGS. 3A and 3B are enlarged drawings, partially in section and partially in elevation, showing the safety switch with the releasing means and the holding means in their respective second position.

Release disc 38 and release plunger 36 and the attached components function as an offset cam within switch 30. Release plunger 36 has a first position, shown in FIG. 2A, in which it is held relatively close to the one end of bore 34. Trigger 43 is positioned on disc 38 and sized to extend through one slot 35 when plunger 36 is in its first position. The length of trigger 43 and the outside diameter of housing 31 are sized to allow switch 30 and the attached well tool to be lowered through a well flow conductor by conventional wireline techniques. When switch 30 is moved upwardly within the well flow conductor, trigger 43 is sized to contact the inside diameter of the well flow conductor preventing upward movement of switch 30 until disc 38 has been rotated and plunger 36 moved to its second position. Trigger 43 has a tip 45 made from hard material such as carbide or tungsten to minimize wear to the end of trigger 43 projecting from housing 31. The second position of release plunger 36 is shown in FIG. 3A in which plunger 36 is spaced longitudinally from the one end of bore 34. Disc 38 has rotated so that trigger 43 does not project through slots 35. Link 40 limits the longitudinal travel of plunger 36 from its first to its second position.

Devices similar to release plunger 36, release disc 38, and their attached components are shown and explained in U.S. Pat. Nos. 2,708,316 and 2,940,524, both to John V. Fredd. U.S. Pat. Nos. 2,708,316 and 2,940,524 are adopted by reference for all purposes.

Second housing subassembly 31*b* has a reduced outside diameter portion 60 near one end thereof. Matching threads 61 are formed on the exterior of portion 60 and within bore 34 near the other end of subassembly 31*a*. Thus, subassemblies 31*a* and 31*b* can be engaged by threads 61 with a portion of subassembly 31*b* extending into bore 34 of subassembly 31*a*. The end of subassembly 31*b* within bore 34 is closed except for a small concentric opening 62 with rod 63 extending therethrough.

Piston 50 has a first position in which it is prevented from sliding relative to housing 31. Means are provided within housing 31 to hold piston 50 in its first position. Rod 63 connects the releasing plunger 36 to the holding means. The end of rod 63, extending from subassembly 31*b*, is secured by two set screws 64 to releasing plunger 36. Rod 63 and opening 62 are concentric with housing 31.

Housing subassembly 31*b* has a longitudinal bore 65 extending from the other end partially therethrough. Bore 65 has a reduced inside diameter 67, within the one end having threads 61, forming shoulder 66 facing in the other direction within bore 65. Sleeve 70 slidably disposed within bore 65 and is generally a hollow cylinder with one end 71 closed except for passageway 72. The other end of rod 63 is threadedly engaged with closed end 71 of sleeve 70. When release plunger 36 is in its first position, sleeve 70 abuts shoulder 66 to define the first position of sleeve 70. Set screws 64 can be used to adjust the engagement of rod 63 with plunger 36 to ensure proper positioning of sleeve 70 when plunger 36 is in its first position.

Spring 73 is disposed within reduced inside diameter 67 between end 71 of sleeve 70 and the one end of subassembly 31*b* within bore 34. When release plunger 36 and sleeve 70 are in their first position, spring 73 is sized to be in compression. Spring 73 provides a means for urging sleeve 70 to move from its first to its second position. Lateral ports 74 extend through housing subassembly 31*b* to communicate fluids exterior to switch 30 with bore 65. Fluids exterior to switch 30 can also communicate between slots 35, bore 34, opening 62, bore 65, and opening 72 into sleeve 70.

Figure 3B:
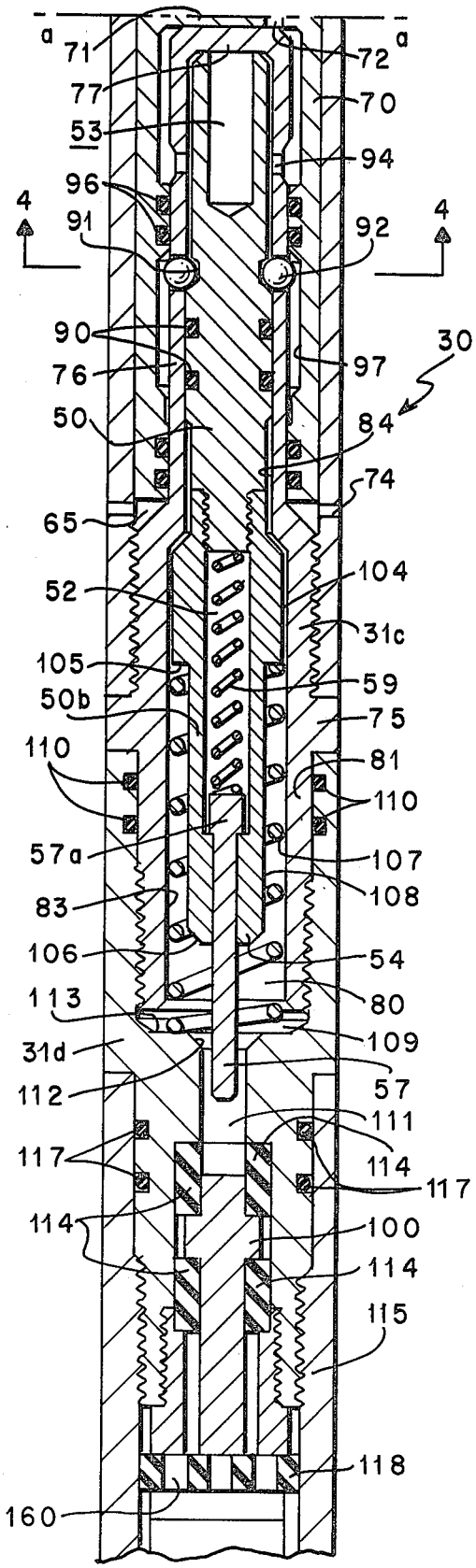
Figure 4:
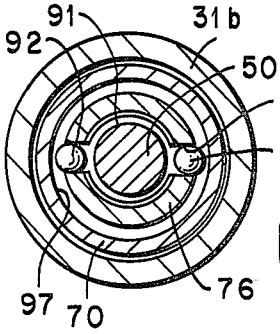
FIG. 4 is a cross-sectional view taken along line 4—4 of FIG. 3B.

The exterior of piston housing 31*c*, except for flange 75, is generally disposed within longitudinal bores 65 and 109 respectively of the adjacent housing subassemblies 31*b* and 31*d*. The outside diameter of flange 75 is compatible with the outside diameter of housing 31 and provides shoulders for interconnecting housing subassemblies 31*b*, 31*c*, and 31*d*. A hollow, cylindrical neck 76 extends longitudinally from subassembly 31*c* into bore 65 of subassembly 31*b*. The inside diameter of sleeve 70 is sized to slide over the exterior of neck 76. The extreme end 77 of neck 76 within bore 65 is closed. The longitudinal travel of sleeve 70 towards its second position is limited by end 77 of neck 76 abutting end 71 of sleeve 70 as shown in FIG. 3B. The inside diameter of bore 65, the inside and outside diameters of sleeve 70, and the outside diameter of neck 76 are sized to allow sleeve 70 to slide between neck 76 and the inside diameter of housing subassembly 31*b*. The limits of longitudinal movement of sleeve 70 between its first and second postions within bore 65 are defined by end 71 abutting shoulder 66 and end 77 of neck 76 respectively.

Portion 81 of piston housing subassembly 31*c* is disposed within housing subassembly 31*d*. Portion 81 is on the opposite side of flange 75 as compared to neck 76. Longitudinal bore 80 extends through piston housing subassembly 31*c* from circular opening 82 in portion 81 until terminated by closed end 77 of neck 76. Bore 80 has a larger inside diameter 83 within portion 81 as compared to inside diameter 84 within neck 76. Tapered shoulder 85 is formed within bore 80 facing in the other direction by the transition between inside diameters 83 and 84.

Piston 50 is slidably disposed within bore 80. For ease of manufacture, piston 50 has two subassemblies 50*a* and 50*b* engaged at threads 51. Piston 50 is generally cylindrical in shape. First longitudinal bore 52 extends partially through piston 50 from opening 56 in end 54 of piston 50. Pin 57 is slidably disposed within first longitudinal bore 52. The inside diameter 55 of a portion of first bore 52 near opening 56 is smaller than the outside diameter of the remainder of first bore 52. Shoulder 58 is formed by this difference in inside diameters within first bore 52. The majority of pin 57 is sized to be slidable within inside diameter 55 except for head 57*a* of pin 57. The outside diameter of head 57*a* is enlarged so that pin 57 is slidably retained by shoulder 58 with first bore 52. Spring 59 is carried within first bore 52 between pin head 57*a* and the end of bore 52 within piston 50. As will be explained later, pin 57 extending from piston 50, comprises a first electrical contact. Spring 59 comprises part of the means for limiting the force with which pin 57 engages second electrical contact 100.

A second longitudinal bore 53 extends from the other end 101 of piston 50 partially therethrough. Depending upon the well conditions, spring 102 may be disposed within second bore 53. Spring 53 provides a means for biasing piston 50 to move to its second position without regard to the fluid pressure surrounding safety switch 30.

The outside diameter of piston subassembly 50*a* is generally compatible with inside diameter 84 of neck 76. Fluid seals 90 are carried on the exterior of piston 50 within neck 76 and engage inside diameter 84 which is part of housing 31. Locking recess or groove 91 is machined in the exterior of piston 50 spaced longitudinally from seals 90. A plurality of balls 92 is carried within openings 93 spaced radially around the circumference of neck 76. Locking recess 91 is spaced longitudinally from end 101 of piston 50 and openings 93 are spaced longtudinally from end 77 of neck 76 such that when end 101 abuts end 77, balls 92 within opening 93 are adjacent locking recess 91.

Lateral ports 94 are provided between end 77 of neck 76 and openings 93 to communicate between bore 80 and the exterior of neck 76. Fluid seals 90 on piston 50 and their contact with inside diameter 84 are positioned such that fluid entering bore 80 through ports 94 cannot communicate with the rest of bore 80 and acts only on one side of fluid seals 90.

As previously noted, sleeve 70 is slidable around the exterior of neck 76. Sleeve 70 has two sets of o-rings 95 and 96 within its inside diameter. O-rings 95 are carried near the other end of sleeve 70 opposite end 71. O-rings 96 are spaced longitudinally from o-rings 95 intermediate the ends of sleeve 70. The spacing between the sets of o-rings 95 and 96 is greater than the longitudinal spacing between openings 93 and ports 94 in neck 76. The inside diameter of sleeve 70 between o-rings 95 and 96 has an enlarged portion 97 and a reduced portion 98. Reduced inside diameter 98 is longitudinally adjacent to o-rings 95. The distance between reduced inside diameter 98 and end 71 of sleeve 70 is selected such that reduced inside diameter 98 is opposite openings 93 and balls 92 when sleeve 70 abuts shoulder 66. The diameter of balls 92, inside diameter 98 and the depth of recess 91 are selected to allow sleeve 70 to hold balls 92 projected into recess 91 when sleeve 70 is in its first position. Thus, piston 50 is held in its first position with end 101 of piston 50 abutting end 77 of neck 76 by inside diameter 98 of sleeve 70 and balls 92. Sleeve 70 is in turn releasably held in its first position with end 71 of sleeve 70 abutting shoulder 66 by rod 63 connected to release plunger 36 in its first position.

When sleeve 70 is allowed to slide within bore 65 by release plunger 36 moving to its second position, enlarged inside diameter 97 is positioned opposite balls 92 as shown in FIG. 3B. Thus, with sleeve 70 in its second position, balls 92 can move radially out of locking recess 91 allowing piston 50 to slide within longitudinal bore 80 of piston housing subassembly 31*c*. Also, when sleeve 70 moves to its second position, lateral port 94 in neck 76 is no longer trapped between the sets of o-ring seals 95 and 96. Fluids, from opening 72 in sleeve 70, can communicate through lateral ports 94 with the portion of bore 80 on the one side of fluid seals 90 when sleeve 70 is in its second position. This fluid can act upon piston 50 and fluid seals 90 tending to move piston 50 from its first to its second position.

As previously noted, inside diameter 83 of bore 80 is larger than inside diameter 84 of bore 80. Subassembly 50*b* of piston 50 within inside diameter 83 has an enlarged outside diameter 104 near the connection with piston subassembly 50*a*. First shoulder 105 is formed on the exterior of piston 50 by enlarged diameter 104. Depending upon the well conditions in which switch 30 is being used, spring 107 may be positioned within bore 80 around reduced outside diameter 108 of piston 50 and resting on shoulder 105.

Portion 81 of piston housing subassembly 31*c* extends into bore 109 of housing subassembly 31*b*. Seals 110 are carried by the inside diameter of housing subassembly 31*d* and form a fluid tight barrier with the exterior of portion 81 when housing subassembly 31*c* is threadedly engaged with housing subassembly 31*d*. A longitudinal passageway 111 extends from the center of bore 109 through housing subassembly 31*d*. Square shoulder 113 and tapered shoulder 112 are formed by the transition between bore 109 and longitudinal passageway 111 on the inside diameter of subassembly 31*d*. The diameter of longitudinal passageway 111 is less than the diameter of end 54 of piston 50 and greater than the diameter of pin 57. Therefore, pin 57 can move within passageway 111, but tapered shoulder 112 engages matching tapered shoulder 106 on end 54 of piston 50 to limit longitudinal travel of piston 50. The longitudinal movement of piston 50 towards its first position is limited by end 101 of piston 50 contacting end 77 of neck 76. The longitudinal movement of piston 50 towards its second position is limited by tapered shoulder 106 on end 54 of piston 50 engaging tapered shoulder 112 on the inside diameter of housing subassembly 31*d*. When spring 107 is installed around reduced diameter 108 of piston 50 between first shoulder 105 and second shoulder 113, spring 107 provides a means for biasing piston 50 to remain in its first position.

Second electrical contact 100 is secured within longitudinal passageway 111 by electrical insulating material 114. Insulating material 114 surrounds electrical contact 100 and prevents it from electrically touching housing 31. Second electrical contact 100 is held stationary relative to housing 31 by insulating material 114.

Tubular housing 115 which carries power supply 21 is engaged by threads 116 by housing subassembly 31*d*. O-ring seals 117 are carried by the exterior of subassembly 31*d* near threads 116 to provide a fluid tight seal between housing 31 and housing 115. Additional electrical insulating material 118 may be carried within housing 115 to provide a good electrical connection between second contact 100 and power supply 21 and preventing electrical contact between second contact 100 and housing 31 and/or 115.

Figure 2B:
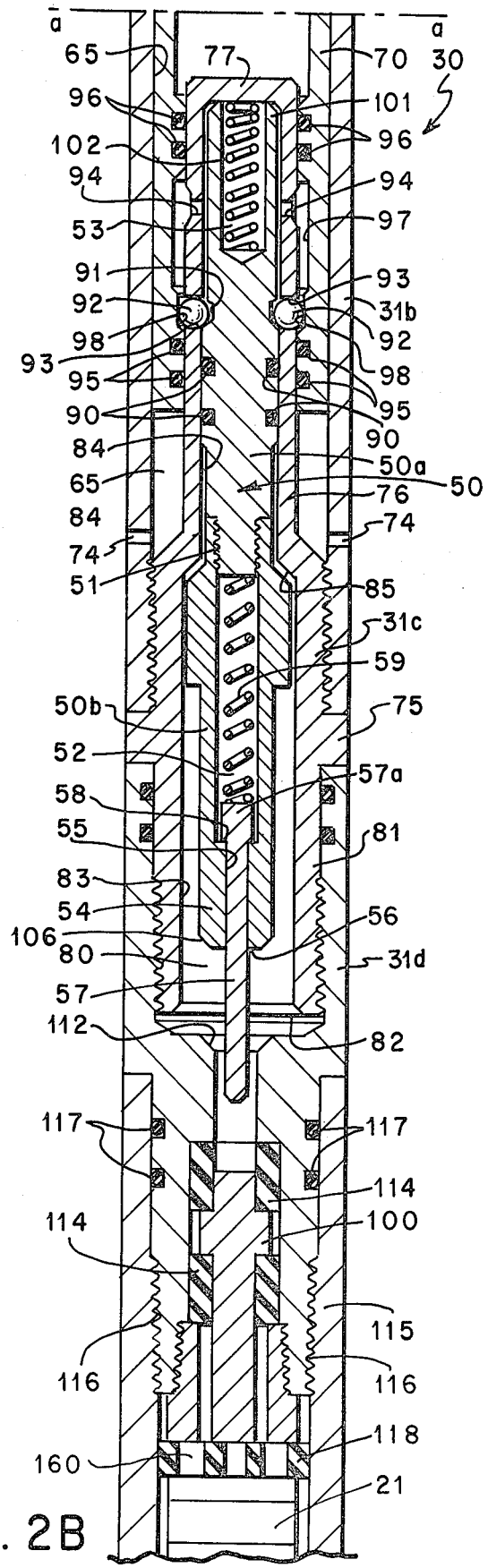

As shown in FIGS. 1A and 2B, insulating material 118 prevents one end of power supply 21 from contacting housing 115. This same end of power supply 21 is held in electrical contact with second contact 100. Enlarged metal rib 119 on the other end of power supply 21 is in electrical contact with housing 115 as shown in FIG. 1B. Pin 57, piston 50, piston housing subassembly 31*c*, and housing 115 are manufactured from electrically conductive material. Thus, the first electrical contact, pin 57, is always electrically connected to housing 31 without regard to position of piston 50. In addition to metal rib 119, electrical contacts 160 are sometimes provided between power supply 21 and tubular housing 115. Insulating material 118 electrically isolates contacts 160 from second electrical contact 100. Electrical contacts 160 and rib 119 have the same polarity. In some well tools such as well perforating gun 20, electrical contacts 160 are preferred because a more reliable electrical contact is ensured by engaging housing 31 with tubular housing 115 and mechanically securing contacts 160 between power supply 21 and housings 31 and 115.

The length of pin 57 and longitudinal passageway 111 are selected such that when piston 50 is in its first position, pin 57 is spaced longitudinally from and does not engage second electrical contact 100. Fluid seals 90 on piston 50, o-rings 100, and o-rings 117 carried by housing subassembly 31*d* provide a means for sealing the first and second electrical contacts from communication with fluids exterior to switch 30.

As previously noted, fluid pressure exterior to switch 30 can communicate to one side of fluid seals 90 when sleeve 70 is in its second position. Since fluid pressure exterior to switch 30 cannot communicate to the portion of longitudinal bores 80 and 90 having the first and second electrical contact, a difference in pressure across fluid seals 90 is possible. When this difference in pressure exceeds a value predetermined by installing spring 107, fluid pressure exterior to switch 30 can move piston 50 to its second position if sleeve 70 has been released to move to its second position.

For use within perforating gun 20, power supply 21 has electrode 131 extending from its lower end thereof and concentric with the longitudinal axis of tubular housing 115. The polarity of electrode 131 is opposite from the polarity of rib 119 and/or electrical contact 160 on power supply 21.

Transmitting subassembly 132 is secured by threads to the lower end of tubular housing 115. O-rings 133 are provided to prevent fluid exterior to housing 115 from communicating with power supply 21. Electrical insulating material 134 is provided within housing 115 around electrode 131 to prevent electrical contact between housing 115 and electrode 131. Transmitting subassembly 132 has an outer housing 135 which is both electrically and mechanically connected to tubular housing 115 and housing 31. Electrode 136 is contained within transmitting subassembly 132 and is electrically isolated from outer housing 135. Electrodes 131 and 136 are electrically connected. Thus, transmitting subassembly 132 as shown in FIG. 1B can be represented electrically as two separate wires connecting power supply 21 and timer 22 to detonator 28 as shown in FIG. 6.

OPERATING SEQUENCE

Well perforating gun 20 is assembled at the well surface and lowered by wireline 121 and running tool 33 through the bore of well flow conductor 122. Depending upon the well conditions, either spring 102 is installed in second bore 53 of piston 50 or spring 107 is installed in bore 80. Springs 102 and 107 would not be used at the same time.

Perforating a well flow conductor and the surrounding formation frequently leaves debris within the openings into the formation. One technique used to eliminate this debris is to perforate the well flow conductor with no fluid pressure within the bore of the flow conductor. Thus, maximum differential pressure is created between the formation and the bore of the flow conductor to flush debris out of the openings back into the flow conductor. When using this technique, fluid pressure is not present exterior to switch 30 to act on the one side of fluid seals 90 and move piston 50 to its second position. Therefore, spring 102 must be placed in bore 53 to ensure positive engagement of first electrical contact 57 and second electrical contact 100 when switch 30 is used in a dry flow conductor.

Frequently, well perforating gun 20 will be used in a well flow conductor filled with a liquid. Under these conditions, spring 107 provides an additional safety feature to ensure that first electrical contact 57 engages second electrical contact 100 when switch 30 is lowered to the desired location within the well flow conductor. The fluid pressure at the location to be perforated can be calculated based on the hydrostatic head of the fluid above this location plus any pressure present at the well surface. Spring 107 is then selected based on this calculated pressure so that the fluid pressure exterior to switch 30 can move piston 50 to its second position. Accidentally tripping trigger 43 while handling perforating gun 20 at the well surface will not cause first electrical contact 57 and second electrical contact 100 to engage if spring 107 is installed.

Safety switch 30 is assembled at the well surface with release plunger 36, sleeve 70, and piston 50, each in their respective first position as best shown in FIGS. 2A and 2B. Perforating gun 20 is then lowered by conventional wireline techniques to the desired locating within well flow conductor 112. Upward pull on wireline 121 results in trigger 43 contacting the inside diameter of well flow conductor 112 and rotating disc 38. Release plunger 36 is allowed to move to its second position by this rotation of disc 38. Spring 73 can then urge sleeve 70, part of the piston holding means, to move to its second position. Balls 92, within openings 93 of neck 76, are freed to move out of locking recess 91 of piston 50 and into enlarged inside diameter 97 of sleeve 70 when sleeve 70 is in its second position. Piston 50 can be moved to its second position either by spring 102 if installed or by fluid pressure acting on the one side of fluid seals 90.

Movement of the piston 50 towards its second position is stopped when tapered shoulder 106 on piston 50 engages tapered shoulder 112 on housing subassembly 31*d*. Pin or first electrical contact 57 is sized to engage second electrical contact 100 when piston 50 is in its second position. Spring 59 allows pin 57 to slide within first longitudinal bore 52 of piston 50 limiting the force with which pin 57 engages second electrical contact 100. The engagement between tapered shoulders 106 and 112 prevents fluid pressure exterior to switch 50 from being applied to pin 57. Spring 59 alone determines the force applied by pin 57 to contact 100.

Referring to FIG. 6, a brief electrical schematic drawing for well perforating gun 20 is shown. As previously noted, U.S. Pat. No. 3,546,478 discloses a power supply, motion sensor, and timer satisfactory for use with perforating gun 20. When pin 57 and second electrical contact 100 are engaged, timer 22 is energized by power supply 21. Timer 22 is preselected to measure a fixed time interval such as ten minutes and then transmit electricity to detonator 28. Timer 22 provides a safety feature by preventing power supply 21 from energizing detonator 28 immediately after pin 57 engages second electrical contact 100.

Motion sensor 23 provides another safety feature. If perforating gun 20 moves after timer 22 has started to measure the preselected time interval, motion sensor 23 will detect this movement. Reset trigger 130 is activated by motion sensor 23 and resets timer 22 to zero. Timer 22 must now measure the complete preselected time interval before detonator 28 is energized.

In summary, well perforating gun 20 has the following safety features. Safety switch 30 must have a trigger 43 mechanically tripped. If spring 107 is installed, fluid pressure exterior to safety switch 30 must exceed a preselected value. A preselected time interval must elapse from after first electrical contact 57 engaging second electrical contact 100 before power supply 21 can energize detonator 28. Each movement of perforating gun 20 during the measurement of this time interval causes a reset of timer 22, and a new time interval must be measured.

The present invention can be used with various well tools to control a power supply energizing electrical circuits within the well tools. The previous description is illustrative of only one of the embodiments of the present invention. Those skilled in the art will readily see other changes, variations, and modifications utilizing the present invention. Changes, variations, and modifications may be made without departing from the scope of the invention which is defined by the claims.

What is claimed is:

1. A switch for activating electrical circuits in a well tool, comprising:

a. a housing;

b. means for attaching one end of the housing to a wireline;

c. a piston slidably disposed within the housing;

d. a first electrical contact comprising a pin projecting from one end of the piston;

e. the piston having a first position in which it is held from sliding relative to the housing with the pin spaced longitudinally from a second electrical contact in the switch and a second position in which the pin can engage the second electrical contact;

f. means for holding the piston in its first position; and g. means for releasing the piston from the holding means.

2. A switch as defined in claim 1, further comprising:

a. means for sealing the first and second electrical contacts from communication with fluids exterior to the switch; and b. means for biasing the piston to remain in its first position until the fluid pressure surrounding the switch exceeds a preselected value.

3. A switch as defined in claim 1, further comprising:

a. means for sealing the pin and second electrical contact from communicating with fluids exterior to the switch; and b. means for biasing the piston to move to its second position without regard to the fluid pressure surrounding the switch.

4. A switch assembly as defined in claim 1, further comprising:

a. a plurality of generally cylindrical subassemblies, each having a longitudinal bore and each threaded for interconnecting the subassemblies to form the housing;

b. the first subassembly having longitudinal slots communicating between the interior and exterior of the subassembly and means for attaching the subassembly to a wireline;

c. a release plunger slidably disposed within the bore of the first subassembly and connected to the piston holding means;

d. a disc rotatably mounted to the release plunger and a trigger, attached to the disc, projecting through one of the longitudinal slots when the piston is held in its first position;

e. a release link connecting the disc to the first subassembly and limiting longitudinal movement of the disc within the bore of the first subassembly; and f. the trigger being sized to engage the inside diameter of a well flow conductor when the switch is moved upward within the flow conductor.

5. A switch, as defined in claim 1, wherein the piston holding means comprises:

a. a sleeve, slidably disposed within the housing, having a first position holding the piston from moving relative to the housing and a second position allowing the piston to move to its second position;

b. a rod connecting the sleeve to the releasing means;

c. means for urging the sleeve to move from its first position to its second position;
d. a piston housing subassembly forming a part of the housing;
e. a portion of the piston housing subassembly comprising a hollow neck, with the piston slidably disposed therein, projecting longitudinally into the bore of an adjacent housing subassembly;
f. the outside diameter of the neck, the inside and outside diameter of the sleeve, and the inside diameter of the adjacent subassembly allowing the sleeve to slide over the neck between the outside diameter of the neck and the inside diameter of the adjacent subassembly; and
g. the second position of the sleeve being defined by the end of the neck contacting the sleeve.

6. A switch, as defined in claim 1, wherein the piston further comprises:
a. means for limiting the longitudinal movement of the piston within the housing; and
b. means for limiting the force with which the pin engages the second electrical contact.

7. A switch, as defined in claim 6, wherein the piston further comprises:
a. a first longitudinal bore extending from one end of the piston partially therethrough;
b. the pin slidably disposed within the first bore with one end of the pin projecting from the bore;
c. a spring disposed within the first bore between the other end of the pin and the end of the bore; and
d. the spring comprising a portion of the means for limiting the force with which the pin engages the second electrical contact.

8. A switch, as defined in claim 7, wherein the piston further comprises:
a. a second longitudinal bore extending from the other end of the piston partially therethrough; and
b. means for biasing the piston to move to its second position disposed within the second longitudinal bore.

9. A switch, as defined in claim 1, further comprising means for electrically isolating the second electrical contact from the housing when the piston is in its first position.

10. A switch, as defined in claim 2, wherein the piston further comprises:
a. fluid seals carried on the exterior of the piston and engaging the inside diameter of the housing;
b. the fluid seals comprising part of the means for isolating the first and second electrical contacts from well fluids;
c. a first shoulder formed on the exterior of the piston; and
d. the means for biasing the piston to its first position comprising a second shoulder, formed on the inside diameter of the housing facing the first shoulder, and a spring disposed around the exterior of the piston between the first and second shoulders.

11. A mechanical switch for activating electrical circuits in a well tool suspended from a wireline within a well flow conductor, comprising:
a. a housing;
b. means for attaching one end of the housing to the wireline;
c. a piston slidably disposed within the housing;
d. a first electrical contact comprising a pin projecting from one end of the piston;
e. the piston having a first position in which the piston is held from sliding relative to the housing and the pin is spaced longitudinally from a second electrical contact in the switch and a second position in which the pin can engage the second electrical contact;
f. means for holding the piston in its first position;
g. means for releasing the piston from the holding means by upward pull on the wireline.

12. A mechanical switch, as defined in claim 11, further comprising:
a. means for sealing the first and second electrical contacts from communication with fluids exterior to the well tool;
b. means for electrically isolating the second electrical contact from the housing when the piston is in its first position; and
c. the first electrical contact electrically connected to the housing without regard to the position of the piston.

13. A mechanical switch, as defined in claim 12, further comprising:
a. a plurality of generally cylindrical subassemblies, each having a longitudinal bore and each threaded for interconnecting the subassemblies to form the housing;
b. the piston having a first longitudinal bore extending from one end of the piston partially therethrough;
c. the pin slidably disposed within the first bore with one end of the pin projecting from the bore; and
d. means for limiting the force with which the pin engages the second electrical contact including a spring disposed within the first bore.

14. A mechanical switch, as defined in claim 13, further comprising:
a. fluid seals carried on the exterior of the piston and engaging the inside diameter of the housing;
b. the fluid seals comprising part of the means for sealing the first and second electrical contacts from fluids exterior to the well tool;
c. a flow passage through the housing allowing fluid pressure exterior of the well tool to act on one side of the fluid seals; and
d. means for biasing the piston to remain in its first position until the fluid pressure exterior to the well tool exceeds a preselected value.

15. A mechanical switch, as defined in claim 14, further comprising:
a. the first subassembly having longitudinal slots communicating between the interior and exterior of the first subassembly and means for attaching the first subassembly to the wireline;
b. a release plunger slidably disposed within the bore of the first subassembly and connected to the piston holding means;
c. a disc rotatably mounted to the release plunger and a trigger, attached to the disc, projecting through one of the longitudinal slots when the piston is in its first position;
d. a release link connecting the disc to the first subassembly and limiting longitudinal movement of the disc within the bore of the first subassembly;
e. the trigger engaging the inside diameter of the well flow conductor and rotating the disc to allow the release plunger to slide relative to the housing when the well tool is moved upward by the wireline.

16. A mechanical switch, as defined in claim 15, wherein the piston holding means comprises:

a. a sleeve, slidably disposed within the housing, having a first position holding the piston from moving relative to the housing and a second position allowing the piston to move to its second position;

b. a rod connecting the sleeve to the releasing means;

c. means for urging the sleeve to move from its first position to its second position;

d. a piston housing subassembly forming a part of the housing;

e. a portion of the piston housing subassembly comprising a hollow neck, with the piston slidably disposed therein, projecting longitudinally into the bore of the adjacent housing subassembly; and f. the sleeve being sized to slide over the neck between the outside diameter of the neck and the inside diameter of the adjacent housing subassembly.

17. A mechanical switch, as defined in claim 13, wherein the piston further comprises:

a. a second longitudinal bore extending from the other end of the piston partially therethrough; and b. means for biasing the piston to move to its second position disposed within the second longitudinal bore.

18. A well perforating gun assembly having a carrier for a detonator and explosive charges, an electrical power supply contained within the gun assembly, and a mechanical switch for activating electrical circuits within the gun assembly to connect the power supply to the detonator comprising:

a. a housing containing the mechanical switch and the electrical power supply;

b. means for attaching one end of the housing to a wireline;

c. a piston slidably disposed within the housing;

d. a first electrical contact comprising a pin projecting from one end of the piston;

e. the piston having a first position in which the piston is held for sliding relative to the housing and the pin is spaced longitudinally from a second electrical contact in the gun assembly and a second position in which the pin can engage the second electrical contact;

f. means for holding the piston in its first position; and g. means for releasing the piston from the holding means by upward pull on the wireline.

19. A well perforating gun assembly, as defined in claim 18, further comprising:

a. means for sealing the first and second electrical contacts from communication with fluids exterior to the gun assembly;

b. means for electrically isolating the second electrical contact from the housing when the piston is in its first position;

c. the first electrical contact electrically connected to the housing without regard to the position of the piston; and d. the first electrical contact movable relative to the housing and the second electrical contact stationary relative to the housing.

20. A well perforating gun assembly, as defined in claim 19, further comprising:

a. a plurality of generally cylindrical subassemblies, each having a longitudinal bore and each threaded for interconnecting the subassemblies to form the housing;

b. the electrical power supply contained within one of the subassemblies and the carrier suspended from the housing;

c. the piston having a first longitudinal bore extending from one end of the piston partially therethrough;

d. the pin slidably disposed within the first bore with one end of the pin projecting from the bore;

e. means for limiting the force with which the pin engages the second electrical contact including a spring disposed within the first bore; and f. engagement of the first and second electrical contact closing the electrical circuit to connect the power supply to the detonator.

21. A well perforating gun assembly, as defined in claim 20, further comprising:

a. fluid seals carried on the exterior of the piston and engaging the inside diameter of the housing;

b. the fluid seals comprising part of the means for isolating the first and second electrical contacts from fluids exterior to the gun assembly;

c. a flow passage through the housing allowing fluids from the exterior of the gun assembly to act on one side of the fluid seals; and d. means for biasing the piston to remain in its first position until the fluid pressure exterior to the gun assembly exceeds the preselected value.

22. A well perforating gun assembly, as defined in claim 21, further comprising:

a. the first subassembly having longitudinal slots communicating between the interior and exterior of the first subassembly and means for attaching the first subassembly to the wireline;

b. a release plunger slidably disposed within the bore of the first subassembly and connected to the piston holding means;

c. a disc rotatably mounted to the release plunger and a trigger, attached to the disc, projecting through one of the longitudinal slots when the piston is in its first position;

d. a release link connecting the disc to the first subassembly and limiting longitudinal movement of the disc within the bore of the first subassembly; and e. the trigger engaging the inside diameter of the well flow conductor and rotating the disc to allow the release plunger to move longitudinally relative to the housing when the gun assembly is moved upward by the wireline.

23. A well perforating gun assembly, as defined in claim 22, wherein the piston holding means comprises:

a. a sleeve, slidably disposed within the housing, having a first position holding the piston from moving relative to the housing and a second position allowing the piston to move to its second position;

b. a rod connecting the sleeve to the releasing means;

c. means for urging the sleeve to move from its first position to its second position;

d. a piston housing subassembly forming a part of the housing;

e. a portion of the piston housing subassembly comprising a hollow neck, with the piston slidably disposed therein, projecting longitudinally into the bore of the adjacent housing subassembly; and f. the sleeve being sized to slide over the neck between the outside diameter of the neck and the inside diameter of the adjacent housing subassembly.

24. A well perforating gun assembly, as defined in claim 20, wherein the piston further comprises:

a. a second longitudinal bore extending from the other end of the piston partially therethrough; and b. means for biasing the piston to move to its second position disposed within the second longitudinal bore.

25. A well perforating gun assembly as defined in claim 18, further comprising means for measuring a preselected time interval after the first and second electrical contacts engage before the electrical circuits to the detonator are energized by the power supply.

26. A well perforating gun assembly, as defined in claim 25, further comprising means for sensing motion of the gun assembly to open the electrical circuit connecting the power supply to the perforating units when the gun assembly is moving.

* * * * *